United States Patent [19]

Murakami et al.

[11] 4,257,778

[45] Mar. 24, 1981

[54] PROCESS FOR PRODUCING SYNTHETIC COKING COAL OF HIGH VOLATILE MATTER CONTENT

[75] Inventors: Tadashi Murakami, Hiratsuka; Mamoru Yamane, Sayama; Toshio Tokairin, Urawa; Kenji Kawai, Tokyo, all of Japan

[73] Assignee: Nihon Kogyo Kabushiki Kaisha, Tokyo, Japan

[21] Appl. No.: 70,469

[22] Filed: Aug. 28, 1979

[30] Foreign Application Priority Data

Jul. 31, 1979 [JP] Japan ..... 54/96795

[51] Int. Cl.[3] ..... C10G 9/14; C10M 7/00

[52] U.S. Cl. ..... 44/1 R; 208/131

[58] Field of Search ..... 208/131, 48 R, 48 Q; 44/1 R

[56] References Cited

U.S. PATENT DOCUMENTS

| | | | |
|---|---|---|---|
| 2,005,118 | 6/1935 | Voorhees | 208/131 |
| 2,029,783 | 2/1936 | Mekler | 208/48 R |
| 2,064,708 | 12/1936 | Wilson | 208/48 R |
| 2,140,276 | 12/1938 | Alther | 208/131 |
| 2,310,748 | 2/1943 | Pearson | 208/131 |
| 3,322,647 | 5/1967 | Calaway | 208/48 Q |
| 3,700,587 | 10/1972 | Hyde | 208/131 |
| 4,036,736 | 7/1977 | Ozaki et al. | 208/131 |
| 4,061,472 | 12/1977 | Ozaki et al. | 208/40 |

*Primary Examiner*—Herbert Levine

*Attorney, Agent, or Firm*—Sughrue, Rothwell, Mion, Zinn and Macpeak

[57] ABSTRACT

A process for producing a synthetic coking coal of high volatile matter content by thermal cracking of a heavy hydrocarbon through the delayed coking process comprising heating said heavy hydrocarbon in a furnace to a temperature between about 380° C. and 500° C. and sufficient to initiate cracking; introducing said heated heavy hydrocarbon into a coking drum where it is maintained at a temperature and for a time sufficient to effect cracking to thereby produce a thermally cracked residue having a volatile matter content of from about 25 to 45 wt % and a Gieseler fluidity of at least about 50,000 ddpm; withdrawing said thermally cracked residue from the coking drum at a temperature selected so as to satisfy the relation:

$$T \leqq 0.293x^2 - 26.12x + 790$$

where T is the temperature (°C.) of the thermally cracked residue; x is the volatile matter content of the residue (wt %) and is in the range of from about 25 to 45 wt %, and bringing said residue into contact with water for cooling and solidification; and the synthetic coking coal product.

9 Claims, 3 Drawing Figures

PROCESS FOR PRODUCING SYNTHETIC COKING COAL OF HIGH VOLATILE MATTER CONTENT

BACKGROUND OF THE INVENTION

1. Field of the Invention

This invention relates to a process for producing a synthetic coking coal having a volatile matter content of about 25 to 45 wt % and a Gieseler fluidity of at least about 50,000 ddpm by thermal cracking of heavy hydrocarbons through the delayed coking process, which can be used as a substitute for natural coking coal. More particularly, this invention relates to a process for defoaming bubbles from the thermally cracked residue in a coking drum during thermal cracking as well as to a process for withdrawing said thermally cracked residue from the coking drum, cooling and solidifying whereby the thermally cracked residue is granulated, and further to a process for effectively recovering the heat of said thermally cracked residue. The present invention also includes the coking coal obtained by the above processes. The term "volatile matter content" as used herein is measured in accordance with ASTM D3175 and represents the percentage of gaseous products, exclusive of moisture vapor, in the coking coal. In addition, Gieseler fluidity is a relative measure of the plastic behavior of the coal as measured in accordance with ASTM D2639 using a Gieseler plastometer. The units of Gieseler fluidity, ddpm, are dial divisions per minute.

2. Description of the Prior Art

Processes have been proposed in U.S. Pat. Nos. 4,036,736 and 4,061,472 for heat treating heavy hydrocarbons to produce a substitute for coking coal suitable as the feedstock for coke production. In subsequent research it has been found that fluidity is a particularly important factor for any product capable of minimizing a shortage of coal feedstock which is likely to occur in Japan and that a thermally cracked residue having a Gieseler fluidity of at least about 50,000 ddpm serves best as the alternative to coking coal. A thermally cracked residue meeting this fluidity requirement and which can be processed in entirely the same manner as natural coking coal feedstock has a volatile matter content of about 25 to 45%, preferably about 30 to 45%, which is considerably higher than the 5 to 15% range of cokes produced by the conventional delayed coking process. Various difficulties occur if thermally cracked residues of such high volatile matter content are processed in entirely the same manner as the conventional delayed coking process. Withdrawal of the thermally cracked residue from the coking drum is particularly difficult and problems occur in each of the following steps of the delayed coking process:

(1) Cooling of the thermally cracked residue with water injected into the coking drum;

(2) Opening of the upper and lower flanges of the coking drum to the atmosphere; and (3) Breaking of the thermally cracked residue with a jet-water cutting machine.

In step (1) above it is difficult to obtain a uniform dispersion of injected cooling water and the injection period as well as the cooling period are more than twice as long as in the conventional technique. When the flanges are opened to the atmosphere in step (2), as an inadequately cooled portion contact the air, inflammation is possible, and due to the plasticity of the thermally cracked residue obtained, breaking with a jet-water cutting machine in the step (3) is not efficient and requires a long time for achieving a desired result.

Furthermore, as thermal cracking of heavy hydrocarbons in a coking drum proceeds, bubbles vigorously form due to concurrently formed cracked oil vapor and cracked gas. Since part of these bubbles are still reactive, those withdrawn from the coking drum may obstruct the effluent line along which the cracked oil vapor and cracked gas from the top outlet of the coking drum are transferred to the downstream fractionator column, and deposits of the thermally cracked residue may form within the fractionator column, thus causing trouble in the operation of the process. In one technique used to prevent these drawbacks, a silicone defoaming agent is injected overhead into the coking drum. However, the thermally cracked residue formed within the coking drum according to the delayed coking process is coke, and bubbles form on or near the surface of the upper portion of the coke layer. In thermal cracking of heavy hydrocarbons as in this invention to produce synthetic coking coal, a major part of the thermally cracked residue in the coking drum is a viscous liquid, and a large quantity of tough bubbles are formed. As a result, the defoaming technique used in the past has been to use a great volume of a silicone defoaming agent or to use a large-scale coking drum in anticipation of the maximum formation of bubbles. As a further disadvantage, the silicone defoaming agent is decomposed in the coking drum and enters the cracked product. Thus, the use of a large amount of the defoaming agent is not desired in view of its effect on the quality of the product. On the other hand, increasing the volume of the coking drum by the volume of the bubbles rather than defoaming is not an economical method to take on an industrial scale.

As a result of extensive research on the physical properties at high temperatures as compared between the coke (volatile matter content: 50 to 15%) produced by the delayed coking process and the thermally cracked residue (volatile matter content: about 25 to 45%) which is to be treated by the process of this invention directed to solving the above problems, it has been found that the coke provided by the conventional delayed coking process accumulates in the coking drum as porous solid matter wiht no Gieseler fluidity at all, whereas the thermally cracked residue can be held in the form of a viscous liquid or slurry in the coking drum within a certain range of temperature. To be more specific, reference to FIG. 1 shows the relationship between the volatile matter content x (wt %) and the temperature of the thermally cracked residue T (°C.). In the region (A) above the curve the relation $T \leqq 0.293x^2 - 26.12x + 790$ holds and it has been found that a thermally cracked residue in the form of a viscous liquid or slurry that can be continuously withdrawn from the coking drum can be obtained. In addition, the withdrawn residue can be brought into contact with water for rapid cooling and solidification to form a granulated product having a particle size such that it can be immediately used, and the thermal energy of the cracked residue can be recovered in the form of steam.

SUMMARY OF THE INVENTION

Accordingly, it is one object of the present invention to provide a process for producing a synthetic coking coal in which a thermally cracked residue can be continuously withdrawn from a coking drum in the form of a viscous liquid or slurry.

It is another object of the present invention to provide a process for producing a synthetic coking coal from a heavy hydrocarbon in which the bubbles formed during thermal cracking are eliminated without the use of a large volume of defoaming agent and, more particularly, a silicone defoaming agent.

It is another object of the present invention to provide a novel means for bringing the thermally cracked residue into contact with water for rapid cooling and solidification.

It is still another object of the present invention to provide a novel synthetic coking coal.

The present invention provides a process for producing a synthetic coking coal of high volatile matter content by thermal cracking of a heavy hydrocarbon through the delayed coking process comprising heating said heavy hydrocarbon in a furnace to a temperature between about 380° C. and 500° C. and sufficient to initiate cracking; introducing said heated heavy hydrocarbon into a coking drum where it is maintained at a temperature and for a time sufficient to effect cracking, e.g., about 30 minutes to 36 hours to thereby produce a thermally cracked residue having a volatile matter content of from about 25 to 45 wt % and a Gieseler fluidity of at least about 50,000 ddpm; withdrawing the thermally cracked residue from the coking drum at a temperature selected so as to satisfy the relation:

$$T \leqq 0.293x^2 - 26.12x + 790$$

where T is the temperature (°C.) of the thermally cracked residue; x is the volatile matter content of the residue (wt %) and is in the range of from about 25 to 45 wt %, and bringing said residue into contact with water for cooling and solidification. The process optionally includes a step of effecting contact between the thermally cracked residue and water under pressure to thereby recover water in the form of steam. The process of this invention may further include injecting a liquid hydrocarbon onto the upper surfaces of bubbles of the thermally cracked residue formed in the thermal cracking coking drum or blowing a gas against said surfaces.

The present invention will be described in more detail by reference to the following detailed description in connection with the accompanying drawings.

DETAILED DESCRIPTION OF THE INVENTION

Figure 2:
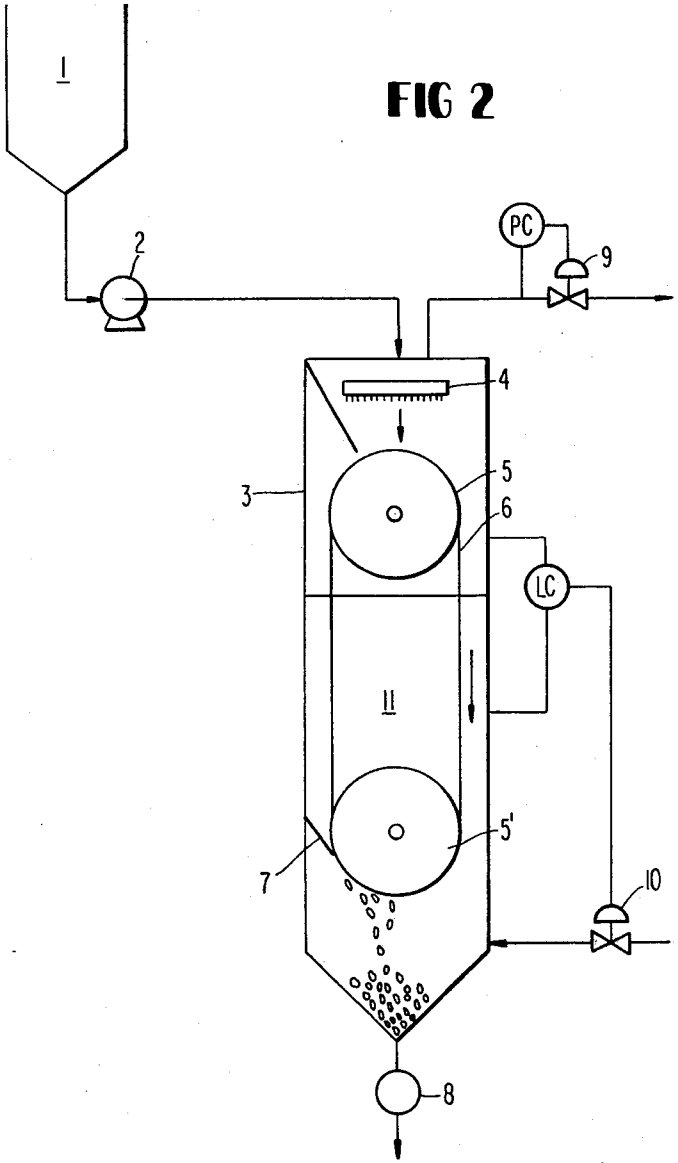
FIG. 2 illustrates one preferred embodiment of the process of this invention.
Figure 1:
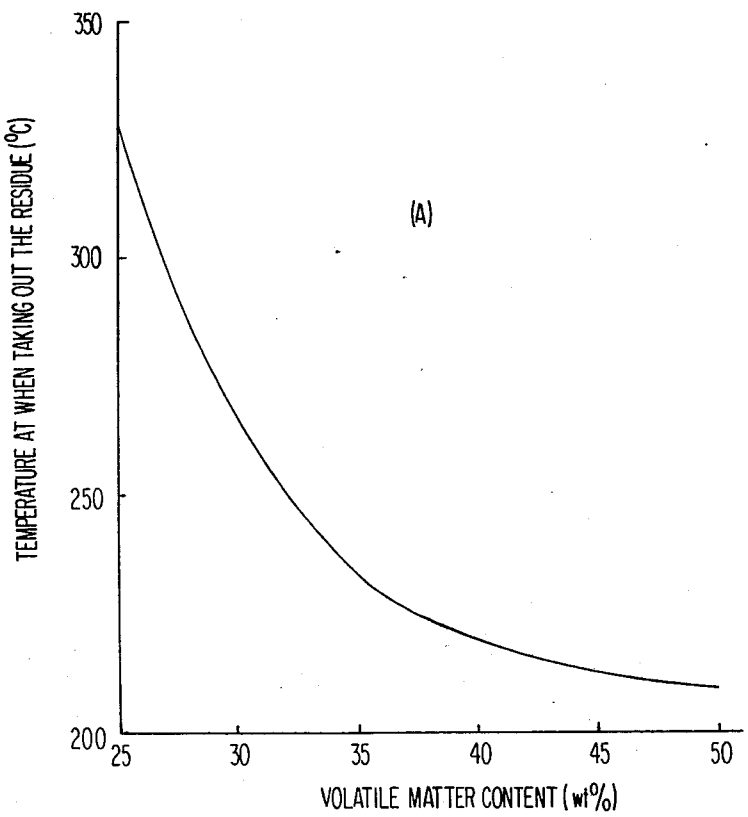
FIG. 1 is a graph showing the relationship between the volatile matter content of the thermally cracked residue and the temperature at which it can be taken out of the coking drum.

Heavy hydrocarbons employed as a feedstock in the process of this invention are thermally cracked by the delayed coking process. The heavy hydrocarbons which can be processed in accordance with the present invention have a boiling point of 360° C. or higher and include atmospheric residue, vacuum residue or naphtha cracked heavy oil, natural asphalt, coal tar, tar sand oil and other heavy petroleum hydrocarbons. These heavy hydrocarbons are heated in a furnace to a temperature between about 380° and 500° C., and are fed to a preheated coking drum (usually at a pressure of about 300 mmHg to 6 kg/cm$^2$, preferably about 1 to 4 kg/cm$^2$), where they are continuously cracked to form a thermally cracked residue as well as cracked gas and oil vapor. The thermally cracked residue gradually accumulates in the coking drum in the form of a liquid or slurry, whereas the cracked gas and oil vapor are separated from the residue and leave the coking drum overhead where they are sent to a downstream fractionator column. In the coking drum a gaseous stripping agent which is not decomposed in the drum may be used such as nitrogen, naphtha, kerosene, gas oil, steam, thermally cracked gas or oil, etc. These agents are used at the coking temperature or lower in an amount of about 300 to 500 l/hr.kg-feedstock.

As the cracked gas and oil vapor are supplied to the fractionator, bubbles are vigorously formed in the accumulated residue which rise up in the coking drum. To defoam such bubbles, a liquid hydrocarbon is injected onto the upper surfaces of these bubbles in an amount of about 1 to 5 wt % based on the weight of the hydrocarbon feedstock, or a gas such as steam, nitrogen or cracked gas is blown against said surfaces at a rate of at least about 10 m/sec. Liquid hydrocarbons which possess a droplet shape as they fall down to the surfaces of the bubbles and gasify or decompose after falling down to thereby remove the heat and rapidly cool the surfaces of the bubbles can be used. By so doing, the bubbles formed on the upper surface of the thermally cracked residue are eliminated. While the liquid hydrocarbon is preferably injected by spraying or other suitable means to achieve uniform application throughout the upper surfaces of the bubbles, experiments have shown that adequate effects can also be achieved by injecting liquid hydrocarbon onto a part, e.g., at least about 50% of these upper surfaces. It is also preferred to blow a gas against the entire portion of the upper surfaces of the bubbles, but blowing a gas against a portion of the upper surfaces has also been found to provide adequate effects.

Examples of the liquid hydrocarbon used as the defoaming agent in the process of this invention are naphtha, kerosene, gas oil, asphalt and thermally cracked oil. Water is also applicable as a defoaming agent.

A preferred gaseous defoaming agent is steam, thermally cracked gas or an inert gas such as nitrogen. The minimum amount of the liquid hydrocarbon injected is about 1 wt %, and the rate of the gas blown is at least about 10 m/sec, and the greater the amount, the faster the defoaming effect occurs, but excessive application should be avoided because it causes greater heat loss in the coking drum.

By performing the cracking reaction at a temperature sufficient to effect cracking, e.g., about 400° to 450° C., and for a time sufficient to effect cracking, e.g., between about 30 minutes and 36 hours, preferably about 2 to 16 hours, a thermally cracked residue having a volatile matter content in the range of from about 25 to 45 wt % and a Gieseler fluidity of at least about 50,000 ddpm is obtained, and depending on the actual volatile matter content it has, the thermally cracked residue is taken out of the coking drum at a temperature that satisfies the relation $T \leqq 0.293x^2 - 26.12x + 790$. A preferred temperature for taking the residue out of the drum is about 50° C. higher than that determined by the equation $T=0.293x^2-26.12x+790$. It is to be understood that the residue may be taken out of the coking drum at a temperature near the reaction temperature without being cooled. It is also to be understood that the thermal cracking may be continued while the residue is being taken out of the coking drum.

The withdrawn residue is immediately contacted with water for cooling and solidification without making contact with air. It is to be noted here that by conducting contact with the cooling water, preferably water at a pressure between 2 to 10 kg/cm$^2$, the heat of the thermally cracked residue can effectively be recovered by making steam.

The molten thermally cracked residue taken out of the coking drum is dispersed in water by a suitable means. A suitable means for dispersion is a dispersion nozzle or a dispersion plate. Two methods can be used to inject the thermally cracked residue into water for cooling: (A) dispersing the residue into a large amount of water for cooling such that the residue settles spontaneously without floating, and (B) forcibly carrying the residue through water for cooling. In method (A), the injected residue contains air bubbles and tends to float on the surface of water and dispersed residue particles of a suitable size gather into a mass which must be broken into small pieces before use. In order to avoid this problem, it is preferred to maintain the temperature of cooling water at a temperature of about 20 20 to 30° C. lower than its boiling point. Alternatively, method (B) can be used. In method (B), molten residue is transported into the cooling water for effective cooling and solidification to form a granulated product.

While cold water is an effective coolant, it is desirably used at a pressure between about 2 to 10 kg/cm$^2$ and recovered as steam having a pressure of about 2 to 10 kg/cm$^2$ for the purpose of achieving efficient heat recovery from the One preferred technique for contacting the thermally cracked residue with water will hereunder be described by reference to FIG. 2. A thermally cracked residue from a coking drum is transferred to a receptacle 1 from which it is fed to a cooling tower 3 by means of a feed pump 2. The cooling tower 3 has at its top a nozzle 4, 5 to 50 mm in diameter. Through this nozzle 4 is passed the thermally cracked residue which falls onto a steel belt 6 running between rotary drums 5, 5' in the cooling tower 3. The surface of the steel belt 6 is provided with partitions placed at intervals of 5 to 50 mm, and the thermally cracked residue deposited on the belt 6 is caused to travel through cooling water 11. The residue thus cooled and solidified contacts a remover 7 which takes the residue off the steel belt 6. The residue is then broken to particles of a suitable size before they are taken out of the cooling tower 3 through a rotary valve 8 as a synthetic coking coal. Part of the cooling water which has absorbed the heat of the thermally cracked residue is converted to steam which is used to control the system pressure at a given level by means of pressure control valve 9 and recovered as steam having a constant pressure. A level control valve 10 is used to supply a proper amount of additional cooling water to the cooling tower 3 at its bottom so that a constant level of the cooling water is maintained. The supplied water flows countercurrent to the movement of the thermally cracked residue and, as it moves upward, the water becomes warmer until it contacts the thermally cracked residue in a liquid form or slurry on the level of the cooling wate or contacts the moving steel belt and vigorously boils to emit steam.

Figure 3:
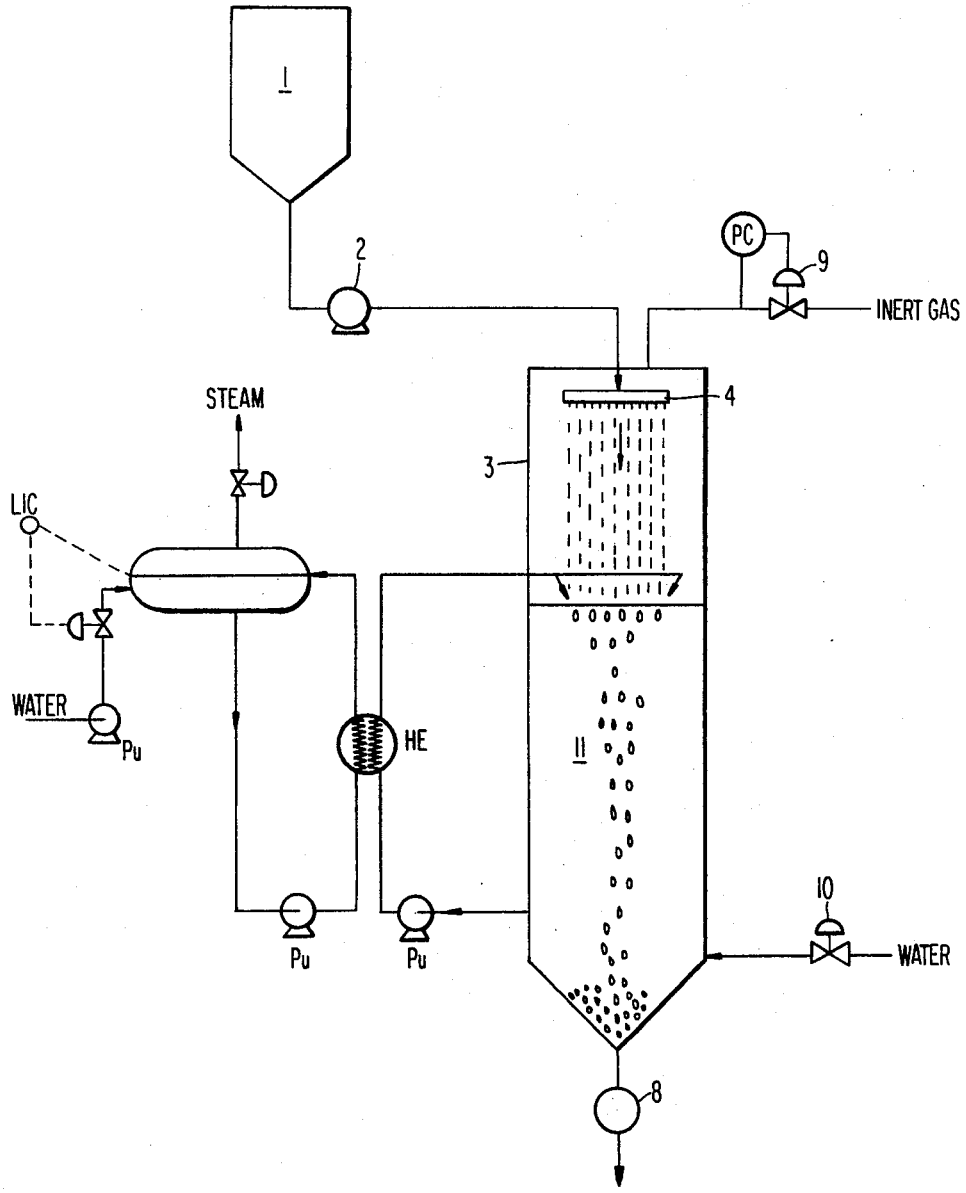
FIG. 3 illustrates another preferred embodiment of the process of this invention.

While the foregoing description concerns a process for recovering the heat of the thermally cracked residue directly as steam, it is to be understood that superheated water may be circulated and recovered as steam through a heat exchanger as illustrated in FIG. 3.

In FIG. 3 corresponding numerals are used to identify those elements also appearing in FIG. 2. In the embodiment shown in FIG. 3, it is preferred that the temperature of the cooling water under a pressure of about 2 to 10 kg/cm$^2$ is about 20° to 30° C. lower than the boiling point thereof, and that the heated cooling water is taken out of the cooling tower and is subjected to heat exchange with low pressure water and then recycled, whereby steam is generated at the low pressure water side.

The cooling tower shown illustratively in FIG. 2 or 3 is of a vertical type, but it may be inclined somewhat or may even be replaced by one of a horizontal type. It is also to be understood that the rate of feeding the thermally cracked residue to the cooling tower 3 and the speed of the steel belt 6 are adjusted depending on the volatile matter content and temperature of the thermally cracked residue. Generally a suitable operation is to feed the residue to the tower and move the belt at a rate of about 5 to 50 cm/sec.

The process of this invention described above is very useful as an industrial process because the thermally cracked residue can be continuously and safely recovered within a short period of time, can achieve cooling, solidification at the same time, and can recover the heat of the residue in an effective manner.

Further in addition, the process of this invention permits easy defoaming of the bubbles from the cracked residue by simply injecting a liquid hydrocarbon onto or blowing a gas against such bubbles, and therefore, there is no need of taking the trouble of increasing the volume of the equipment by the amount of possible bubbles. Non-use of a silicone defoaming agent adds to the economy of the process and eliminates the problem of the defoaming agent which enters the product to reduce its commercial value. As a further advantage, the process is free from other problems caused by the bubbles such as obstruction of the effluent line and formation of deposits in the fractionator column, and as a result, extended operation is assured by the process.

The advantages of the process of this invention will be described in greater detail by reference to the following examples and comparative examples which are given here for illustrative purposes only and are by no means intended to limit the scope of the invention.

EXAMPLE 1

A vacuum residue derived from Kuwait crude oil was passed through a coking drum at a temperature of 405° C. and at a pressure of 0.3 kg/cm$^2$G for a period of 20 hours. The resulting thermally cracked residue having a volatile matter content of 33% was stripped with gas oil for a period of one hour. Thereafter, the lower valve (2 in. diameter) of the drum was opened to supply it with a pressure of 2 kg/cm$^2$ so as to transfer the residue to a receptacle preheated to 400° C. When the upper flange of the drum was opened, the thermally cracked residue had been completely transferred to the receptacle. The residue was further pumped to a cooling tower of the same type as illustrated in FIG. 2 where it was cooled and solidified into particles having an average size of 6 m/m. The following conditions were employed for the cooling.

| | |
|---|---|
| Temperature of the thermally cracked residue: | 380° C. |
| Internal pressure of the cooling tower: | 10 kg/cm$^2$ |
| Temperature of water fed: | 80° C. |
| Belt partition interval: | 6 m/m |
| Belt speed: | 5 cm/sec. |
| Cooling water ascension rate: | 5 cm/sec. |

EXAMPLE 2

Thermally cracked residue received in a receptacle of the type used in Example 1 was poured down a cooling tower of the same type as illustrated in FIG. 2 so that it was cooled and solidified and, in addition, its heat was recovered as steam at 2 kg/cm$^2$. 40 kg of steam at 125° C. was generated per 300 kg of the thermally cracked residue at 400° C.

COMPARATVE EXAMPLE 1

A vacuum residue derived from Kuwait crude oil was passed through a coking drum at a temperature of 400° C. and at a pressure of 0.3 kg/cm$^2$G for a period of 16 hours at a rate of 40 kg/hr, and as a result, 300 kg of a thermally cracked residue having a volatile matter content of 45 wt% was produced.

After thermal cracking, gas oil was supplied for 10 minutes to strip the unreacted feedstock, then cooling water was injected for cooling the thermally cracked residue. It took 10 hours for the internal temperature of the drum fall to 150° C. When the upper and lower flanges of the drum were opened at 150° C. part of the uncooled residue burst into flame and emitted smoke. A jet-water cutting machine (200 kg/cm$^2$) was used to take out the thermally cracked residue from the system. It took 3 hours to empty the coking drum of about 300 kg of the residue.

The same coking drum was used to produce a thermally cracked residue having a volatile matter content of 10.8% through reaction at 450° C. for a period of 24 hours. It took 4 hours to cool the residue to 150° C. and one hour to take out the residue from the coking drum with a jet-water cutting machine.

EXAMPLE 3

A feedstock was charged into a coking drum at a temperature of 409° C. and at a pressure of 0.3 kg/cm$^2$G. 12 hours later bubbles reached the line marked on the level gauge at the top of the drum, and 2.3 wt% of gas oil (S.G. 0.8231, b.p. 167–311° C.) based on the weight of the charge was continuously injected dropwise into the drum overhead, whereupon the bubbles fell below the marked level, and they never returned to that level until the completion of the thermal cracking.

EXAMPLE 4

A feedstock was charged into a coking drum at a temperature of 408° C. and at a pressure of 0.3 kg/cm$^2$G. 14 hours and 30 minutes later bubbles reached the line marked on the level gauge and 2.3 wt% of thermally cracked oil (S.G. 0.8052, b.p. 48–377° C.) based on the weight of the charge was continuously injected dropwise into the drum overhead, whereupon the bubbles fell below the marked level, and they never returned to that level until the completion of the thermal cracking.

EXAMPLE 5

A feedstock was charged into a coking drum at a temperature of 411° C. and at a pressure of 1.0 kg/cm$^2$G. 13 hours later bubbles reached the line marked on the level gauge and steam was continuously sprayed overhead onto the surfaces of the bubbles at 155° C. and at 11 kg/cm$^2$ at a rate of 12 m/sec whereupon the bubbles fell below the marked level, and they never returned to that level until the completion of the thermal cracking.

COMPARATIVE EXAMPLE 2

A feedstock was charged into a coking drum at a temperature of 410° C. and at a pressure of 0.3 kg/cm$^2$G, and 11 hours later bubbles reached the line marked on the level gauge. The operation was continued for an additional 13 hours when the bubbles exceeded the marked line and never dropped below this level afterward. Checking after completion of the thermal cracking revealed excessive fouling of the top of the drum and the degassing line between the coking drum and fractionator column. Continued operation resulted in an obstructed degassing line on the third day, which necessitated a shutdown of the operation.

While the invention has been described in detail and with reference to specific embodiments thereof, it will be apparent to one skilled in the art that various changes and modifications can be made therein without departing from the spirit and scope thereof.

What is claimed is:

1. A process for producing a synthetic coking coal of high volatile matter content by thermal cracking of a heavy hydrocarbon through the delayed coking process, said process comprising heating said heavy hyrocarbon in a furnace to a temperature between about 380° C. and 500° C. and sufficient to initiate cracking; introducing said heated heavy hydrocarbon into a coking drum where it is maintained at a temperature and for a time sufficient to effect cracking to thereby produce a thermally cracked residue having a volatile matter content of from about 25 to 45 wt% and a Gieseler fluidity of at least about 50,000 ddpm; withdrawing said thermally cracked residue in the form of a viscous liquid or slurry from the coking drum at a temperature satisfying the relation:

$$T \leqq 0.293x^2 - 26.12x + 790$$

wherein T is the temperature (°C.) of the thermally cracked residue; x is the volatile matter content of the residue and is in the range of from about 25 to 45 wt%, and bringing said residue into contact with water for cooling and solidification.

2. The process of claim 1, wherein bubbles of the thermally cracked residue formed in the coking drum are defoamed by injecting a liquid hydrocarbon or water in an amount of about 1 to 5% by weight based on the weight of the charge of said heavy hydrocarbon onto the upper surfaces of the bubbles or by blowing a gas at a rate of at least about 10 m/sec against the same.

3. The process of claim 2, wherein said liquid hydrocarbon is naphtha, kerosene, thermally cracked oil, gas oil, heavy oil or asphalt.

4. The process of claim 2, wherein said gas is nitrogen, steam or a thermally cracked gas.

5. The process of claim 1, wherein said thermally cracked residue is brought into contact with water for cooling under pressure without contact with air and for solidification.

6. The process of claim 5, wherein said pressure is about 2 to 10 kg/cm$^2$.

7. The process of claim 1, wherein steam is generated by subjecting said cooling water to heat exchange with water under low pressure and said steam is recovered.

8. The process of claim 1, wherein said thermally cracked residue is caused to drop and form deposits on a steel belt or a resin coated steel belt whereby the residue is carried through water for cooling and solidification of the residue, and the resulting steam is recovered.

9. A synthetic coking coal of high volatile matter content prepard by heating a heavy hydrocarbon in a furnace at a temperature sufficient to initiate cracking between about 380° C. and 500° C., cracking said heated heavy hydrocarbon to thereby produce a thermally cracked residue having a volatile matter content of about 25 to 45 wt% and a Gieseler fluidity of at least about 50,000 ddpm, withdrawing said thermally cracked residue in the form of a viscous liquid or slurry from a coking drum, and bringing said residue into contact with water, said residue being at a temperature satisfying the relation:

$$T \leqq 0.293x^2 - 26.12x + 790$$

wherein T is the temperature (°C.) of the residue and x is the volatile matter content in the range of from about 25 to 45 wt% after cracking.

* * * * *

UNITED STATES PATENT AND TRADEMARK OFFICE

CERTIFICATE OF CORRECTION

PATENT NO. : 4,257,778

DATED : March 24, 1981

INVENTOR(S) : TADASHI MURAKAMI ET AL

It is certified that error appears in the above—identified patent and that said Letters Patent is hereby corrected as shown below:

In the Abstract the sign "$\leqq$" in the equation should read -- $\geqq$ --.

Column 2, line 53, Column 3, line 30 and Column 4, line 65, the sign "$\leqq$" in the equations should read -- $\geqq$ --.

Column 5, line 28, the term "20" (first occurrence) should be deleted.

Column 5, line 37, after "the" insert -- thermally cracked residue.--.

Claim 1, Column 8, line 48, the sign "$\leqq$" in the equation should read -- $\geqq$ --.

Claim 9, Column 9, line 15, "prepard" should read -- prepared --.

UNITED STATES PATENT AND TRADEMARK OFFICE

CERTIFICATE OF CORRECTION

PATENT NO. : 4,257,778

DATED : March 24, 1981

INVENTOR(S) : TADASHI MURAKAMI ET AL

It is certified that error appears in the above—identified patent and that said Letters Patent is hereby corrected as shown below:

Claim 9, column 10, line 11, the sign "$\leq$" in the equation should read -- $\geq$ --.

Signed and Sealed this

*Seventh* Day of *September 1982*

[SEAL]

*Attest:*

GERALD J. MOSSINGHOFF

*Attesting Officer*

*Commissioner of Patents and Trademarks*